US011685480B2

(12) United States Patent
Cooper

(10) Patent No.: US 11,685,480 B2
(45) Date of Patent: Jun. 27, 2023

(54) DROP STITCH INFLATABLE SEAT

(71) Applicant: BOTE, LLC, Fort Walton Beach, FL (US)

(72) Inventor: Corey Cooper, Fort Walton Beach, FL (US)

(73) Assignee: BOTE, LLC, Miramar Beach, FL (US)

( * ) Notice: Subject to any disclaimer, the term of this patent is extended or adjusted under 35 U.S.C. 154(b) by 233 days.

(21) Appl. No.: 17/165,337

(22) Filed: Feb. 2, 2021

(65) Prior Publication Data

US 2022/0242530 A1 Aug. 4, 2022

(51) Int. Cl.

| | |
|---|---|
| ***B63B 29/04*** | (2006.01) |
| ***B63B 32/77*** | (2020.01) |
| ***B63B 34/26*** | (2020.01) |

(52) U.S. Cl.

CPC ..... *B63B 29/04* (2013.01); *B63B 32/77* (2020.02); *B63B 34/26* (2020.02); *B63B 2029/043* (2013.01)

(58) Field of Classification Search

CPC ..... A47C 4/54; A47C 1/146; B63B 2029/043; B63B 34/26; B63B 34/52; B63B 32/51; B63B 32/70

See application file for complete search history.

(56) References Cited

U.S. PATENT DOCUMENTS

| | | | | |
|---|---|---|---|---|
| 2,180,426 | A * | 11/1939 | Milligan | A47C 1/146 297/380 |
| 3,499,682 | A | 3/1970 | Orenstein | |
| 4,518,203 | A * | 5/1985 | White | A47C 17/045 297/109 |
| 5,029,928 | A | 7/1991 | Huber | |
| 5,996,527 | A | 12/1999 | Ambrozic | |
| 6,886,204 | B2 * | 5/2005 | Kasatshko | A47C 4/54 297/452.41 |
| 2007/0012236 | A1 * | 1/2007 | Caples | B63B 34/20 114/347 |
| 2014/0078760 | A1 | 3/2014 | Rossini | |
| 2020/0107640 | A1 | 4/2020 | Cooper | |
| 2022/0089256 | A1 * | 3/2022 | Cannon | B63B 32/40 |

OTHER PUBLICATIONS

WO 2014/195349, Cox, Malcolm, Dec. 11, 2014. (Year: 2014).*
International Search Report dated Apr. 18, 2022 for International Patent Application No. PCT/US2022/014667 (2 pages).
Written Opinion of the International Searching Authority dated Apr. 18, 2022 for International Patent Application No. PCT/US2022/014667 (6 pages).

* cited by examiner

*Primary Examiner* — Sarah B McPartlin
(74) *Attorney, Agent, or Firm* — Talus Law Group LLC

(57) ABSTRACT

A seat made of drop stitch material has a back panel, a bottom panel, and a support panel, where the back and bottom panels are adjustably and detachably connected to each other at a substantially orthogonal orientation, and the support portion tilts or reclines the seat into a recumbent position which is advantageous for paddling while sitting on the upper surface of a watercraft.

13 Claims, 4 Drawing Sheets

DROP STITCH INFLATABLE SEAT

BACKGROUND OF THE INVENTION

1. Field of the Invention

The present invention relates generally to aquatic sports and recreation, and more specifically to an inflatable seat used with inflatable kayaks, paddleboards, boards, boats and any other watercraft having a ride or stand on top configuration. More particularly, the invention uses drop stitch construction to make inflatable panels configured to form a seat back and seat bottom, detachably mounted to the upper surface of an aquatic vehicle, such as a kayak. Because drop stitch fabric allows for the creation of panels having the strength and rigidity of solid wood or fiberglass panels, the seat can resist reaction forces of a user paddling from a seated position and thereby direct paddling force to the paddle with greater efficiency.

2. Description of the Related Art

A wide variety of watercraft are in use today for sports and recreation, including kayaks, standup paddleboards, surfboards, boats, and floats. Floats are a category of water craft that are generally inflated by human lung power, or by blowers, but in any event are not pressurized to more than 2 or 3 psi. A float of general rectangular shape is designed for the user to lay flat on its upper surface. Due to the relatively low pressure of inflation, a user cannot stand on a float, nor is sitting a possibility, as the float would fold into a V-shape, if the user is positioned in the middle of the float. Again, this is due to the relatively low pressurization of the float. Higher pressures are not possible without distorting the flat, rectangular intended shape of the flat because there is nothing to hold the opposite, flat surfaces of the float in a substantially parallel, planar orientation.

Standup paddleboards, known as "SUPs," that are made of inflatable, drop stitch material are unique in that they can be stood upon, sat upon, and otherwise stressed without deformation due to the fact that multiple strands, threads, or yarns, extend between opposite sheets of flexible, plastic material and hold the opposite sheets in parallel, spaced position when inflated to high pressures such as pressures between 4 and 20 psi. When inflated, panels made of drop stitch material adopt the strength and hardness of solid wood or fiberglass or rigid plastic aquatic vessels.

One advantage of SUPs made of drop stitch material is that they are light-weight and easily stowed, carried and deployed on site by inflation. Solid SUPs are carried on roof racks or in truck beds, but in any case, they are relatively difficult to transport. An obvious disadvantage is that a solid SUP cannot be carried on an airplane without making special accommodations for shipping. On the other hand, an inflatable drop stitch SUP can be carried as normal luggage, or as carry-on luggage, due to small space required when the SUP is deflated and folded into a compact space.

A kayak is a small, narrow watercraft which is typically propelled by means of a double-bladed paddle. A typical kayak has a covered deck and one or more cockpits, each seating one paddler. The cockpit can be covered by a spray deck that prevents the entry of water from waves or spray, differentiating the craft from a canoe. Neither a kayak nor a canoe is stable when a user stands up inside or on either watercraft. Both can be provided with a seat. A canoe seat is typically a horizontal panel that extends from one side to the other, near one end of the canoe, with no back-supporting vertical panel. Kayaks may also have a seat, either built-in as a molded plastic single piece unit, or as a simple bottom pad, where back support is provided where the cockpit rim hits the user. Some add-on seats are available for both, and may take the form of a foldable cloth unit with an aluminum frame. In any event, add-on seats are bulky, difficult to stow and deploy, and space inefficient. Once on board, they are impediments for someone who does not need or want a seat, and if used as a seat, they cannot be easily disassembled and stowed in a compact space.

For "sit-on-top" kayaks of non-inflatable construction, a seat is often integrally formed in the top surface of the kayak, along with other deformations, pockets and shapes to provide footrests, gear stowage, and other functionality. Because of their overall shape and designed functionality, sit-on-top kayaks are not stable for standing, and are therefore not suitable substitutes for SUP like use, where the user stands on the top surface and paddles while standing. Likewise, the known commercially available flat SUPs are not designed to operate like a kayak where the user sits on top and paddles while sitting. While such use would be possible, a typical SUP does not have a seat suitable for use in conjunction with a SUP. Known aftermarket seats are generally not suitable for use on a SUP or on inflatable kayaks. Thus, a need exists for an inexpensive, cost effective, easily stowed and deployed seat suitable for use on flat or relatively flat watercraft, particularly suitable for converting a standup paddle craft to a sit-on watercraft.

SUMMARY OF THE INVENTION

In one aspect of the present invention, a seat for use with a watercraft having an upper surface includes a bottom panel made of inflatable drop stitch material including an upper surface and a lower surface and a peripheral sidewall, a back panel made of inflatable drop stitch material including a front surface and a rear surface and a peripheral sidewall, first means for connecting the bottom panel to the back panel, and second means for connecting the bottom panel to the upper surface of the watercraft.

Preferably, the upper surface, lower surface, and peripheral sidewall of the bottom panel together define an airtight chamber which is inflatable to a pressure between 4 and 20 psi, and when deflated, the bottom panel takes very little space, and together with other parts of the seat, can be folded into a very compact space, for easy stowage, and rapid deployment when ready for use.

The front surface, rear surface, and peripheral sidewall preferably together define an airtight chamber which is inflatable to a pressure between 3 and 20 psi, and when deflated, the back panel takes very little space, and together with other parts of the seat, can be folded into a very compact space, for easy stowage, and rapid deployment when ready for use.

Preferably, the bottom panel and the back panel are connected to each other through first means disposed along a rear portion of the bottom panel and a bottom portion of the back panel. The first means can be a detachable coupling means, or a permanent coupling means. When detachable, the bottom panel and the back panel are separate from each other, during stowage, but after inflation, the two panels can be connected using any suitable detachable coupling structure. The coupling, whether permanent or detachable, preferably provides a pivotal connection so that the angle of the back portion relative to the bottom portion, can be adjusted to a desired orientation.

Preferably, the seat includes second means for detachably connecting the seat to an upper surface of the watercraft. In one embodiment, the second means include a pair of nylon straps which can be permanently mounted at opposite sides of the bottom panel, and detachably coupled to the upper surface of the watercraft by providing a G-hook at the distal ends of the straps which connect to D-rings or other suitable coupling devices mounted on the upper surface of the watercraft. The straps are adjustable in length to allow forward or rearward positioning of the seat 10, or could also be of fixed length, if no forward and rearward adjustment is either desired or necessary.

In a preferred embodiment, the seat further includes a pair of straps provided on opposite sides of the seat, to connect the upper portion of the back panel to a mid to forward portion of the bottom panel. When connected, the straps fix the angular relationship between the back panel and the bottom panel, with a particularly preferred orientation being 90 degrees or slightly greater, and up to about 120 degrees. The straps can be permanently connected to the back panel, and detachably connected to the bottom panel, so that if the two panels are detachably coupled to each other, the straps will be carried by the back panel and free of the bottom panel. The detachable coupling can be effected by providing a G-hook or other suitable coupling which cooperates with a complementary structure mounted on the bottom panel.

In a preferred embodiment, the seat includes a support panel made of inflatable drop stitch material and includes an upper surface, a lower surface, and a peripheral sidewall, which together define an airtight chamber inflatable to a pressure between 3 to 20 psi. When deflated, the support panel takes very little space, and together with other parts of the seat, can be folded into a very compact space, for easy stowage, and rapid deployment when ready for use.

The upper surface of the support panel is connected to the lower surface of the bottom panel and a forward portion of the bottom panel, to thereby prop the bottom panel up at an angle selected to position the seat in a reclining position. The preferred angle of recline is between 10 and 25 degrees and more preferably 15 degrees. The bottom panel could also be flat against the upper surface of the watercraft, or at 0 degrees, in case a user wanted to sit in a normal seat position, meaning not recumbent. In that situation, the seat would not require a support panel and the bottom panel would rest flat upon the watercraft upper surface. A further alternative, with or without the support panel, would be to provide second bottom panel, as way to raise the height of the seat for a more relaxed and comfortable paddling activity. In that case, the two bottom panels could be bonded together, and could be in fluid communication so only one inflation valve would be necessary to inflate the two panels.

An inflation valve is disposed in the bottom panel for inflating the bottom panel and the support panel simultaneously, if the two panels are in fluid communication with each other. This can occur by providing an air passageway through the upper surface of the support panel and the lower surface of the bottom panel. The position of the inflation valve can be anywhere although preferably away from where the user sits, but more preferably as shown in the drawings.

The bottom panel and the support panel are preferably bonded to each other along the abutting surfaces by any conventional means, including adhesive bonding, heat welding or melting. The surfaces are made of plastic sheets and are capable of being welded or glued together. Optionally, a second inflation valve can be provided on the support panel if fluid communication is not desirable between the two panels.

The bottom panel is preferably connected to the back panel in a way that allows for pivotal movement between the two panels. The pivotal connection can be effected by any simple mechanical means, such as by bonding a PVC strip of material between the two panels to act as a hinge. This can be done with any suitable bonding means, such as by adhesive bonding, heat bonding, Velcro strips or any other complementary fastening means.

One particularly preferred way of connecting the two panels is by providing a hinge type structure which includes a rail which is bonded to the peripheral sidewall of the back panel, and a track adhesively bonded to the upper surface of the bottom panel. Given the generally orthogonal positioning of the back panel relative to the seat panel, the nylon yarns will be at right angles to each other. A protrusion on the end of the rail slides into the track to provide a strong, yet detachable and pivotal connection between the two panels.

Another aspect of the invention is to provide a method of converting a stand-on-top paddle watercraft to a sit-on-top paddle watercraft, which includes the steps of forming a seat from a plurality of panels made of drop stitch inflatable material, the seat including at least a back panel and a bottom panel, inflating the plurality of panels, propping the bottom panel of the seat upwardly at an angle to define a recumbent position for a user, adjusting and then fixing an angular relationship between the back portion of the seat and the bottom portion of the seat; and detachably connecting the seat to an upper surface of the watercraft.

The invention also includes using the inflatable drop stitch seat as a flotation device, or safety device, such as to assist a swimmer or boater in trouble by throwing the seat in their direction, possibly with a tether rope to pull the swimmer or boater to the watercraft or otherwise to safety. The same seat could be used by the watercraft user if the user slipped and fell of the watercraft and could reach the seat as a flotation aid.

Other aspects of the invention will become apparent in view of the following detailed description and claims.

DETAILED DESCRIPTION OF THE INVENTION

Figure 1:
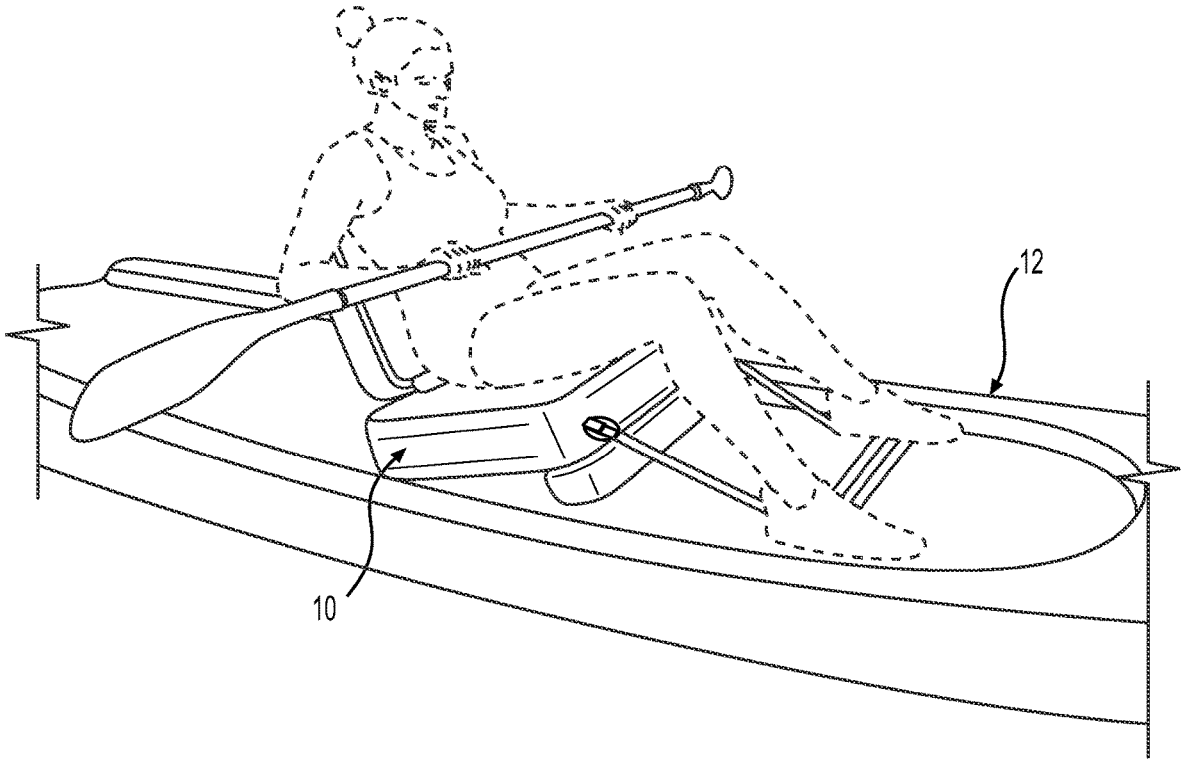
FIG. 1 is a side perspective view of an inflatable drop stitch seat according to one aspect of the present invention, connected to an upper surface of a watercraft.
Figure 2:
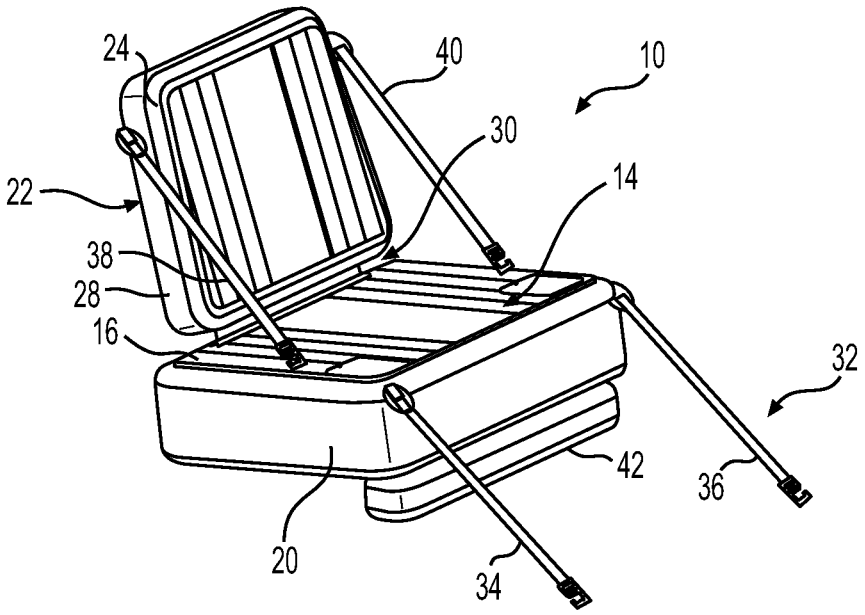
FIG. 2 is an enlarged side perspective view of the seat of FIG. 1, separate from a watercraft.

Referring to FIGS. 1-5, a seat 10 is connected to a watercraft 12 at the upper surface thereof. The watercraft 12 can be virtually any of the type that would be capable of use as a stand on top watercraft, such as a SUP, stand up kayak, or other watercraft that is capable of maintaining stability when a user is standing on the top surface. A particularly attractive feature of the present invention is that the seat 10 can convert a stand on top SUP into a sit on top kayak. The watercraft 12 depicted in FIG. 1 is in the category of an inflatable, drop stich SUP normally paddled by the user in a standing position. In this position, certain muscles of the body are in use that are not used when sitting and paddling from a kayak position. A user can switch back and forth, from sitting to standing, and back again, depending on the intended muscular work out. For example, kayak paddling will work out more of the arm and shoulder muscles, while SUP paddling involves more of the stomach and back muscles.

The seat 10 includes a bottom panel 14 made of inflatable drop stitch material including an upper surface 16, a lower surface 18, and a peripheral sidewall 20, which together define an airtight chamber which, because of a drop stitch construction, can be inflated to high pressures, in the range of 3 to 20 psi. When deflated, the bottom panel 14 takes very little space, and together with other parts of the seat, can be folded into a very compact space, for easy stowage, and rapid deployment when ready for use.

A back panel 22 is made of inflatable drop stitch material and includes a front surface 24, a rear surface 26, and a peripheral sidewall 28 which together define an airtight chamber which, because of a drop stitch construction, can be inflated to high pressures, in the range of 3 to 20 psi. When deflated, the back panel 22 takes very little space, and together with other parts of the seat, can be folded into a very compact space, for easy stowage, and rapid deployment when ready for use.

The bottom panel 14 and the back panel 22 are connected to each other through first means 30 disposed along a rear portion of the bottom panel 14 and a bottom portion of the back panel 22. The first means 30 can be a detachable coupling means, or a permanent coupling means. When detachable, the bottom panel 14 and the back panel 22 are separate from each other, during stowage, but after inflation, the two panels can be connected using any suitable detachable coupling structure. The coupling, whether permanent or detachable, provides a pivotal connection so that the angle of the back portion 22 relative to the bottom portion 14, can be adjusted to a desired orientation.

Figure 3:
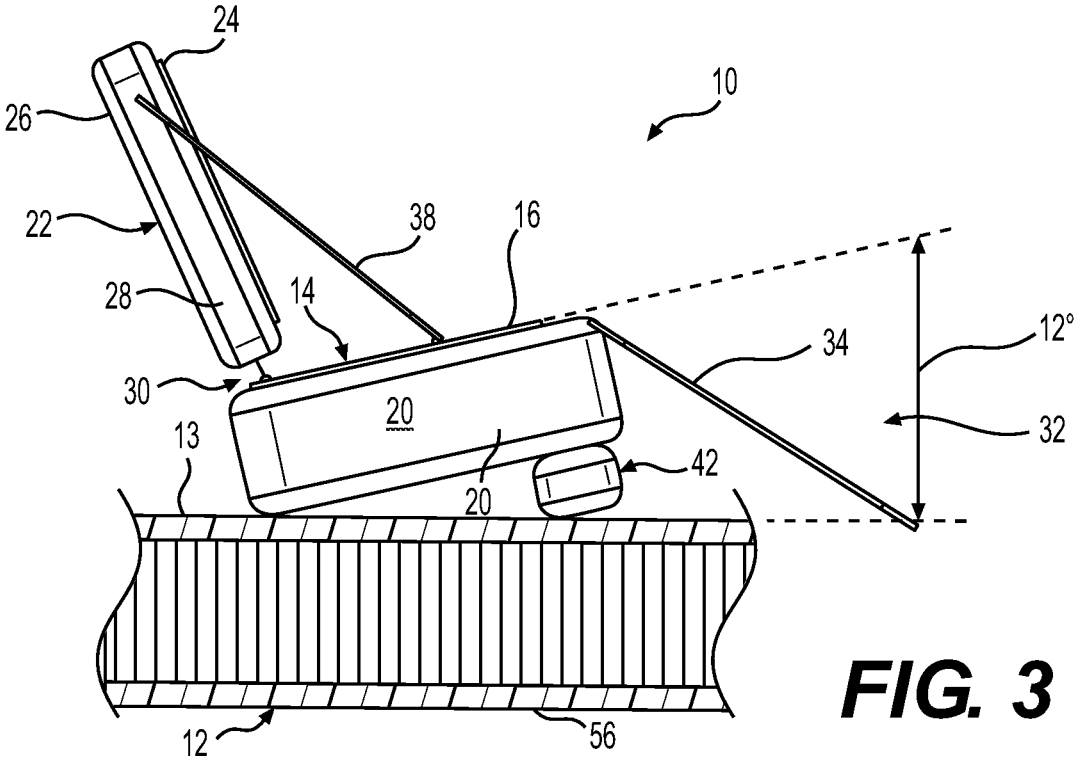
FIG. 3 is a side view of the seat of FIGS. 1 and 2, showing a sectional view of a watercraft and the seat positioned on the upper surface of the watercraft, and the drop stitch construction of the watercraft which is essentially the same construction as the individual panels which comprise the seat.

As seen in FIG. 3, the seat 10 is detachably connected to an upper surface 13 of the watercraft 12 by second means 32. The second means 32 include a pair of nylon straps 34 and 36 which can be permanently mounted at opposite sides of the bottom panel 14, and detachably coupled to the upper surface 13 by providing a G-hook at the distal ends of the straps 34 and 36 which connect to D-rings or other suitable coupling devices mounted on the upper surface 13 of the watercraft 12. The straps 34 and 36 are adjustable in length to allow forward or rearward positioning of the seat 10. The straps 34 and 36 could also be of fixed length, if no forward and rearward adjustment is either desired or necessary. The connectors for connecting the straps to the watercraft can be any suitable complementary coupling means, such as snap fit male/female connectors, hook and ring connectors, or any suitable complementary or non-complementary couplers.

The seat 10 further includes a pair of straps 38 and 40 provided on opposite sides of the seat 10, to connect the upper portion of the back panel 22 to the forward portion of the bottom panel 14. When connected, the straps 38 and 40 fix the angular relationship between the back panel 22 and the bottom panel 14, with a particularly preferred orientation being 90 degrees or slightly greater, and up to 120 degrees. The straps 38 and 40 can be permanently connected to the back panel 22, and detachably connected to the bottom panel 14, so that if the two panels are detachably coupled to each other, the straps 38 and 40 will be carried by the back panel 22 and free of the bottom panel 14. The detachable coupling can be effected by providing a G-hook or other suitable coupling which cooperates with a complementary structure mounted on the bottom panel 14.

The seat 10 further includes a support panel 42 made of inflatable drop stitch material including an upper surface 44, a lower surface 46, and a peripheral sidewall 48, which together define an airtight chamber which, because of a drop stitch construction, can be inflated to high pressures, in the range of 3 to 20 psi. When deflated, the support panel 42 takes very little space, and together with other parts of the seat, can be folded into a very compact space, for easy stowage, and rapid deployment when ready for use.

The support panel 42 is permanently affixed to the lower surface 18 of the bottom panel 14 at a forward end thereof, and provides a prop to cause the seat 10 to be in a recumbent position, slightly reclining, which is optimized for transmitting paddling power from the user to the oar. In particular, the back panel resists reaction force generated by the power stroke of the paddle, so that the user does not have to use energy to resist the reaction force and can instead direct all power to the paddle. The angle of reclining is preferably between 0 and 20 degrees and more preferably between 10 and 15 degrees. At 0 degrees there would be no need for the support panel 42, although a second bottom panel could be used to raise the seat height for greater comfort.

Figure 4:
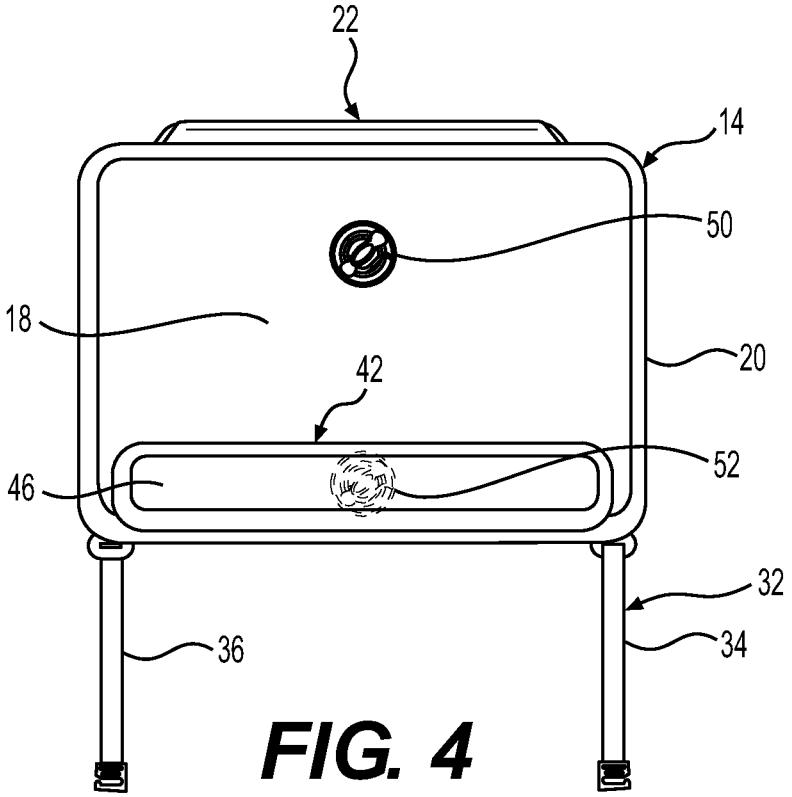
FIG. 4 is a bottom view of the seat of FIGS. 1-3.

As seen in FIG. 4, an inflation valve 50 is disposed in the bottom panel 14 for inflating the bottom panel 14 and the support panel 42, when the two panels are in fluid communication with each other. This can occur by providing an air passageway through the upper surface 44 of the support panel 42 and the lower surface 18 of the bottom panel 14. The two panels are bonded to each other along the abutting surfaces by any conventional means, including adhesive bonding, heat welding or melting. The surfaces are made of plastic sheets and are capable of being welded or glued together. Optionally, a second inflation valve 52 can be provided on the support panel 42 if fluid communication is not desirable between the two panels.

Figure 5:
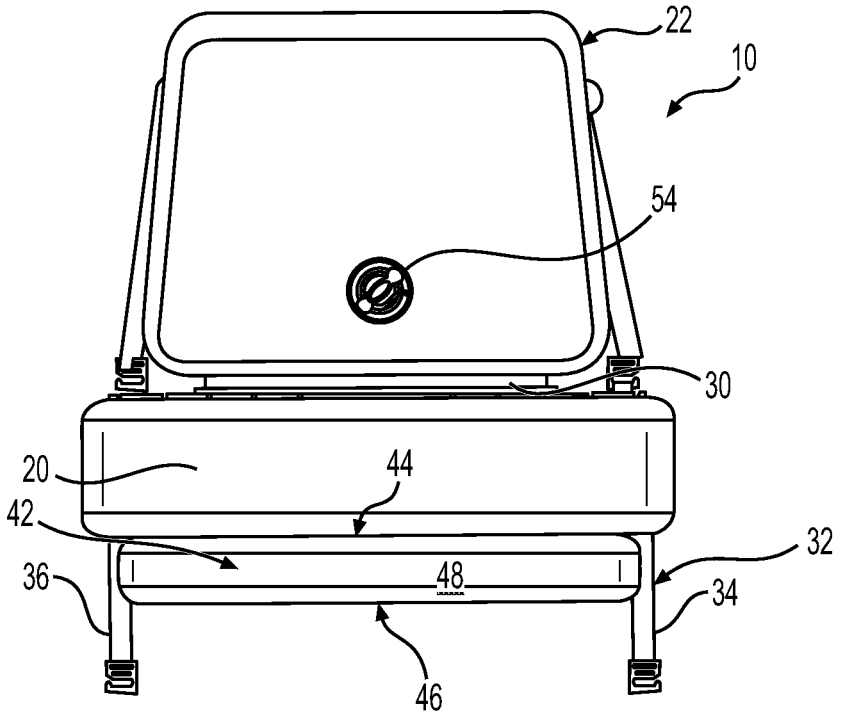
FIG. 5 is rear view of the seat of FIGS. 1-4.

As seen in FIG. 5, the back panel 22 includes its own inflation valve 54 given that the back panel 22 will be slightly spaced from the bottom panel 14 so as to allow pivotal movement between the bottom panel 14 and the back panel 22.

Referring to FIG. 3, the watercraft 12 is made of the same drop stitch material as the individual panels 14, 22 and 42. Typically, drop stitch construction includes a first layer (or first multiple layers) of PVC material which in FIG. 3 comprises the upper surface 13 of the watercraft 12. A second layer 56 of PVC material is spaced apart from the first layer, and is connected internally by a plurality of nylon yarns that extend vertically between the two layers. The yarns allow the internal, airtight chamber formed by the two layers to be inflated at high pressures. When so inflated, the substantially planar structure, which forms the watercraft 12, is hard, and strong to the extent of being comparable to a solid wooden or fiberglass product. This allows for many advantages, including making a large watercraft easily stored, stowed, and deployed in situ, without need for special carrying or handling, such as roof top automotive transport.

By no means is the present invention limited to use with a watercraft of any particular construction. The seat can be used on drop stitch inflatable SUPs, or on solid boards. The watercraft 12 is illustrated as a drop stitch inflatable structure to provide a description that is the same as is used to make the seat 10.

Figure 6:
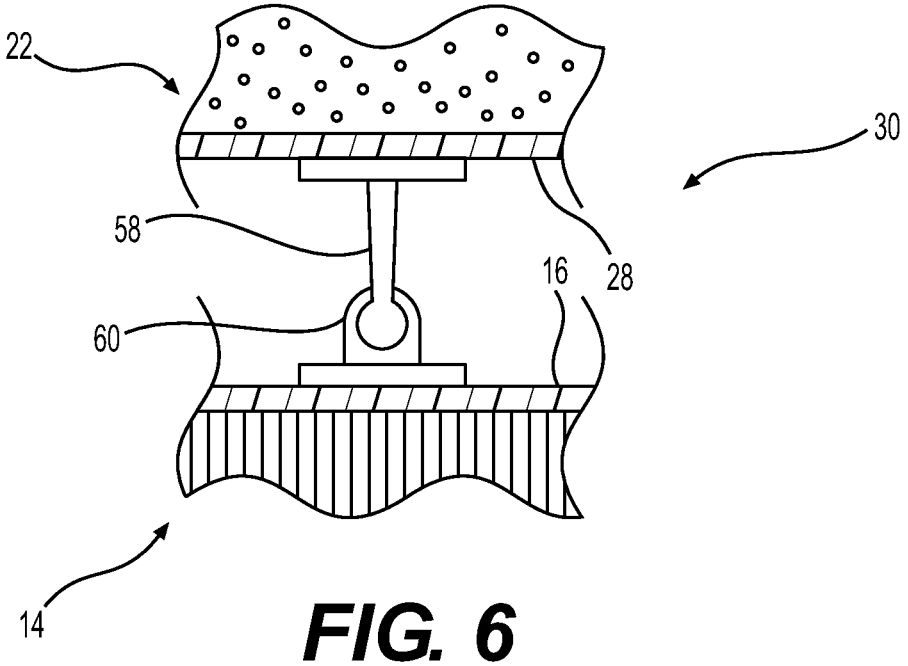
FIG. 6 is an enlarged, end view of a preferred coupling between the bottom panel and the back panel.

Referring to FIGS. 3 and 6, the first means 30 for connecting the bottom panel 14 to the back panel 22 allows for pivotal movement between the two panels. The pivotal connection can be effected by any simple mechanical means, such as by bonding a PVC strip of material between the two panels to act as a hinge. This can be done with any suitable bonding means, such as by adhesive bonding, heat bonding, Velcro strips or any other complementary fastening means.

One particularly preferred way of connecting the two panels is by providing the structure shown in FIG. 6, which includes a rail 58 which is bonded to the peripheral sidewall 28 of the back panel 22. A ball or protrusion on the end of the rail slides into a track 60 adhesively bonded to the upper surface 16 of the bottom panel 14. Given the generally orthogonal positioning of the back panel 22 relative to the seat panel 14, FIG. 6 illustrates the nylon yarns being at right angles to each other.

The invention includes a method of converting a stand-on-top paddle watercraft to a sit-on-top watercraft. For conventional stand-on-top watercraft, such as a SUP, the user paddles from a standing position, and the upper surface of the SUP is substantially planar and unobstructed. If a user merely sat on the SUP and paddled, the reaction forces generated by paddling would cause the user to exert energy to keep from being moved off the SUP, fore, aft and side to side. A seat would allow the user to be stabilized in a sitting position, as if in a kayak, or on a kayak. Currently available aftermarket seats are not portable, easily stowed or stored, and are not easily attached to flat surfaces.

The method of the present invention would include forming a seat from a plurality of panels made of drop stitch inflatable material, the seat including at least a back panel and a bottom panel, inflating the plurality of panels, propping the bottom panel of the seat upwardly at an angle to define a recumbent position for a user, adjusting and then fixing an angular relationship between the back portion of the seat and the bottom portion of the seat, and detachably connecting the seat to an upper surface of the watercraft. In this way, a SUP could be used as both a SUP for stand up paddling, and as a kayak for sit down paddling. Both provide exercise for different muscle groups, and each provides its own unique form of recreation.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A seat for use with a watercraft having an upper surface, comprising:

a bottom panel made of inflatable drop stitch material including an upper surface and a lower surface and a peripheral sidewall;

a back panel made of inflatable drop stitch material including a first surface and a rear surface and a peripheral sidewall;

first means for connecting the bottom panel to the back panel; and second means for connecting the bottom panel to the upper surface of the watercraft;

wherein the first means comprises a rail bonded to the peripheral sidewall of the back panel, and a track adhesively bonded to the upper surface of the bottom panel, wherein a protrusion on the end of the rail slides into the track to provide a strong, detachable and pivotal connection between the back panel and the bottom panel.

2. The seat of claim 1, wherein the upper surface, lower surface, and a peripheral sidewall of the bottom panel together define an airtight chamber which is inflatable to a pressure between 4 and 20 psi.

3. The seat of claim 2, wherein the front surface, rear surface, and peripheral sidewall of the back panel together define an airtight chamber which is inflatable to a pressure between 3 and 20 psi.

4. The seat of claim 1, wherein the second means comprises a pair of nylon straps connected to opposite sides of the bottom panel, and adapted to detachably connect to the upper surface of the watercraft.

5. The seat of claim 4, wherein the nylon straps include detachable fasteners disposed on end portions of the pair of nylon straps.

6. The seat of claim 5, wherein the straps are adjustable in length to allow forward or rearward positioning of the seat.

7. The seat of claim 1, further comprising a pair of straps connecting an upper portion of the back panel to a forward portion of the bottom panel.

8. The seat of claim 1, further comprising a support panel made of inflatable drop stitch material and including an upper surface, a lower surface, and a peripheral sidewall, which together define an airtight chamber inflatable to a pressure between 3 to 20 psi.

9. The seat of claim 8, wherein the upper surface of the support panel is connected to the lower surface of the bottom panel at a forward portion of the bottom panel, to thereby prop the bottom panel up at an angle selected to position the seat in a reclining position.

10. The seat of claim 9, wherein the angle of reclining is between 0 and 20 degrees.

11. The seat of claim 8, wherein each of the bottom panel, the back panel and the support panel include a separate inflation valve through which each panel is inflated.

12. The seat of claim 8, further comprising an air passageway through the upper surface of the support panel and the lower surface of the bottom panel.

13. The seat of claim 12, wherein the bottom panel comprises a chamber in fluid communication with the chamber of the support panel.

* * * * *